US010065295B2

(12) United States Patent
Su

(10) Patent No.: US 10,065,295 B2
(45) **Date of Patent: *Sep. 4, 2018**

(54) TOOL HEAD

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 559 days.

This patent is subject to a terminal disclaimer.

(21) Appl. No.: 14/717,015

(22) Filed: May 20, 2015

(65) Prior Publication Data

US 2015/0258669 A1 Sep. 17, 2015

Related U.S. Application Data

(63) Continuation-in-part of application No. 13/705,263, filed on Dec. 5, 2012, now Pat. No. 9,375,829.

(30) Foreign Application Priority Data

Jun. 21, 2012 (TW) ..... 101122176 A

(51) Int. Cl.

| | |
|---|---|
| ***B25B 23/00*** | (2006.01) |
| ***B25B 13/06*** | (2006.01) |
| *B25B 15/02* | (2006.01) |

(52) U.S. Cl.

CPC ..... *B25B 23/0035* (2013.01); *B25B 13/06* (2013.01); *B25B 15/02* (2013.01)

(58) Field of Classification Search

CPC ... B25B 23/0035; B25B 15/02; B25B 15/001; B25B 23/12; B25B 23/0042; B25B 13/06

See application file for complete search history.

(56) References Cited

U.S. PATENT DOCUMENTS

| | | | |
|---|---|---|---|
| 4,096,896 | A | 6/1978 | Engel |
| 5,074,173 | A | 12/1991 | Cearley |
| 5,351,586 | A | 10/1994 | Habermehl et al. |
| 6,745,652 | B2 | 6/2004 | Chen |
| 7,051,630 | B2 | 5/2006 | Lee |
| 7,104,164 | B2 | 9/2006 | Jirele et al. |
| 7,261,023 | B2 | 8/2007 | Taguchi |

(Continued)

FOREIGN PATENT DOCUMENTS

| | | | |
|---|---|---|---|
| CN | 201220286 | Y | 4/2009 |
| DE | 20022413 | U1 | 12/2001 |

(Continued)

*Primary Examiner* — Monica Carter
*Assistant Examiner* — Danny Hong
(74) *Attorney, Agent, or Firm* — Alan D. Kamrath; Kamrath IP Lawfirm, P.A.

(57) ABSTRACT

A tool head includes a connecting component, a driving component, and a spacer assembled together. The connecting component includes a receiving end forming a first compartment and a second compartment. The driving component includes an engaging end forming a first engaging section and a second engaging section. The tool head has a tight-fit region in which the first engaging section and the spacer are tightly fit within the first compartment and a fit region in which the second engaging section is retained within the second compartment.

13 Claims, 8 Drawing Sheets

(56) References Cited

U.S. PATENT DOCUMENTS

| | | | | |
|---|---|---|---|---|
| 8,109,183 | B2 | 2/2012 | Santamarina et al. | |
| 8,172,236 | B2 | 5/2012 | Shibata | |
| 8,549,963 | B2 | 10/2013 | Chuang | |
| 2004/0065176 | A1 | 4/2004 | Lin | |
| 2006/0269179 | A1 | 11/2006 | Miyasaka et al. | |
| 2010/0294092 | A1 | 11/2010 | Hu | |
| 2016/0193723 | A1* | 7/2016 | Su | B25B 13/06 81/438 |

FOREIGN PATENT DOCUMENTS

| | | | |
|---|---|---|---|
| DE | 202007016650 | U1 | 3/2008 |
| JP | 2005254407 | A | 9/2005 |
| TW | M369832 | U | 12/2009 |
| TW | M374939 | U | 3/2010 |
| TW | 201129449 | A | 9/2011 |
| TW | 352648 | I | 11/2011 |
| TW | M422455 | U | 2/2012 |
| TW | 201210762 | A | 3/2012 |

* cited by examiner

TOOL HEAD

CROSS REFERENCE TO RELATED APPLICATION

The present application is a continuation-in-part application of U.S. patent application Ser. No. 13/705,263 filed on Dec. 5, 2012, of which the disclosure is incorporated herein.

BACKGROUND OF THE INVENTION

1. Field of the Invention

The present invention relates to a tool head and, particularly, to a tool head not susceptible to breakage easily.

2. Description of the Related Art

A conventional tool head includes a connecting end for connecting the tool head to a tool or a tool handle and a driving end for driving an object to be driven. Generally, the conventional tool head is a one-piece structure and is made of relatively harder material to withstand the object to be driven and which wears the tool head when the tool head is driven to drive the object to be driven.

Some conventional tool heads have a relative longer longitudinal length for specific tools or tool handles, and are made in two pieces in order to save material and cost. Such conventional tool head includes a connecting member and a driving member fitted in the connecting member. In order for the driving member to be tightly fitted in the connecting member, the connecting member has greater hardness than that of the driving member. Unfortunately, such conventional tool head is not strong enough to undergo a relatively large toque when the connected tool or tool handle starts turning it, and is also susceptible to breakage when being rotated rapidly.

TW Patent No. I352,648 discloses a connecting member and a driving member fitted in the connecting member. The driving member includes a connecting portion, a polygonal shaped portion extending from the connecting portion, and a cylindrical shaped portion extending from the polygonal shaped portion. The connecting, polygonal shaped and cylindrical shaped portions are coaxial with one another. Additionally, an outer diametrical size of the cylindrical shaped portion is smaller than that of the polygonal shaped portion. The connecting member includes a polygonal shaped slot, a cylindrical shaped slot extending from polygonal shaped slot, and a receiving slot. The polygonal shaped slot receives the polygonal shaped portion, with peripheral surfaces thereof abutted against each other when the driving member is fitted in the connecting member. Likewise, the cylindrical shaped slot receives the cylindrical shaped portion, with peripheral surfaces tightly abutted against each other when the driving member is fitted in the connecting member. It is appreciated that the driving member would not withstand large toque and is also susceptible to breakage for the reason as set forth.

The present invention is, therefore, intended to obviate or at least alleviate the problems encountered in the prior art.

SUMMARY OF THE INVENTION

According to the present invention, a tool head is usable as an adaptor such that a tool is connectable to an end of the tool head and an object to be driven is connectable to another end of the tool head, respectively. The tool head includes a connecting component including a first distal end thereof forming a connecting end connectable to the tool. The connecting component includes a second distal end thereof forming a receiving end forming a receptacle. The receptacle forms a first compartment and a second compartment. The first compartment has a diametrical size not greater than the second compartment. The second compartment has one of two opposite distal ends open to the first compartment and the other distal end opening to a distal end of the connecting component. The second compartment includes a plurality of vertical sides disposed circumferentially and forming a polygonal periphery. Each of the plurality of vertical sides of the second compartment extends at a first length in a lengthwise direction of the receiving end.

A driving component includes a first distal end thereof forming an engaging end insertable in the receiving end. The driving component includes a second distal end thereof forming a driving end connectable to the object to be driven. The engaging end inserted in the receiving end has a first engaging section received in the first compartment and a second engaging section received in the second compartment, respectively. The first engaging section has a width smaller than the diametrical size of the first compartment such that a gap is formed between the first engaging section and the first compartment. The second engaging section and the second compartment have matching polygonal shapes. The engaging end disposed outside the plurality of vertical sides of the second compartment measures a second length in a lengthwise direction of the driving component. The second length is smaller than the first length.

A spacer is made of metal. The spacer has an annular shape. The spacer is disposed in the gap. The spacer includes an inner periphery thereof forming a first tight-fit edge and an outer periphery thereof forming a second tight-fit edge, respectively. The first tight-fit edge surrounds and abuts the first engaging section. The second tight-fit edge surrounds and abuts with a periphery of the first compartment.

The tool head is configured to prevent the connecting component from detaching from and rotating relative to the driving component such that the tool head has a tight-fit region in which the spacer tightly fits between the first engaging section and the first compartment and a fit region in which the second engaging section is received and retained within the second compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is an object of the present invention to provide a tool head that overcomes the set forth problems.

It is another object of the present invention to provide a tool head that withstands high torque transmission.

It is yet another object of the present invention to provide a tool head including a driving component, a connecting component, and a spacer assembled together, having tight-fit and fit regions, allowing aligned assembly to avoid damaging the components set forth, and being configured to prevent the connecting component from detaching from and rotating relative to the driving component.

Other objects, advantages, and new features of the present invention will become apparent from the following detailed description of the invention when considered in conjunction with the accompanied drawings.

DETAILED DESCRIPTION OF THE INVENTION

Figure 1:
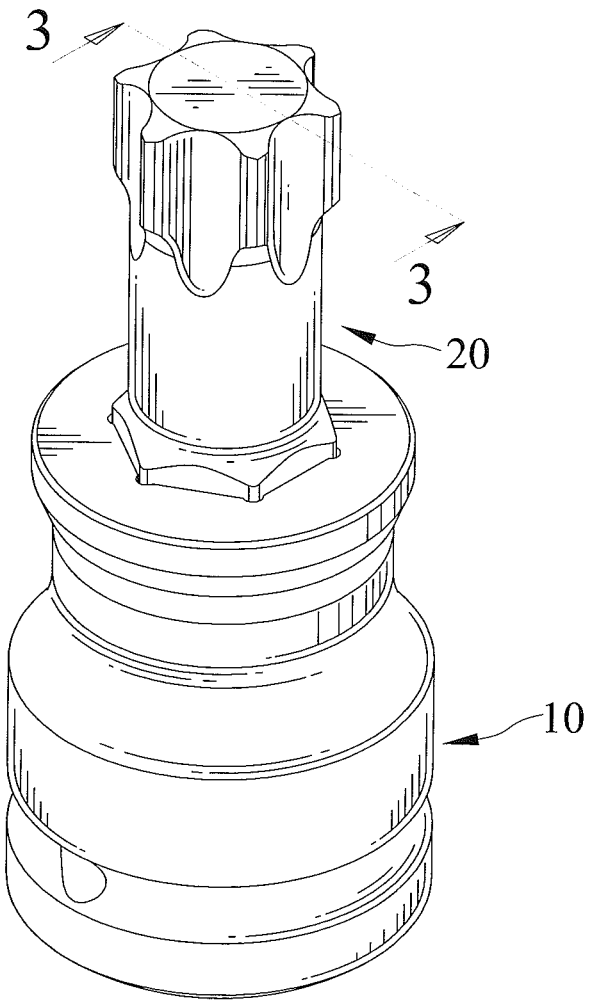
FIG. 1 is a perspective view of a tool head in accordance with a first embodiment of the present invention.
Figure 2:
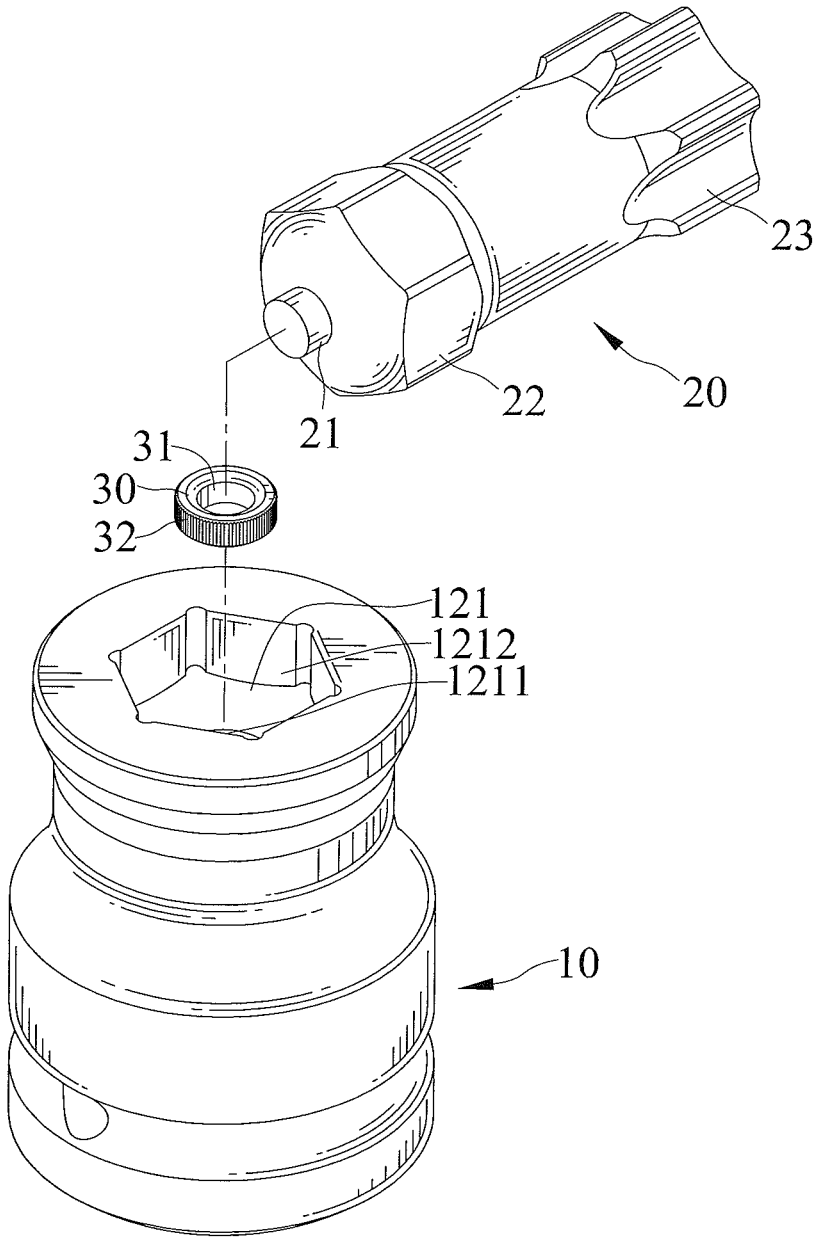
FIG. 2 is an exploded perspective view of the tool head of FIG. 1.
Figure 3:
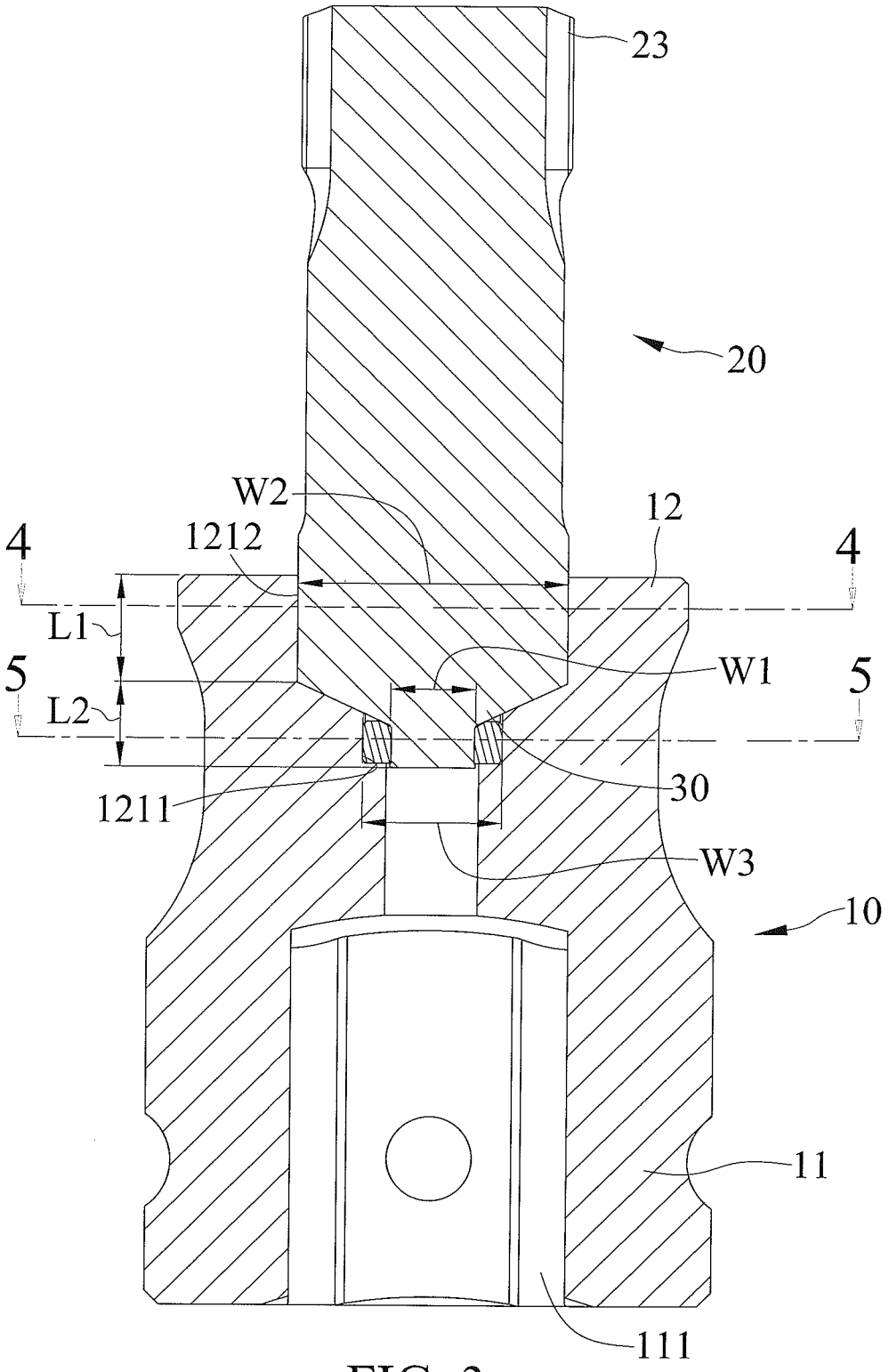
FIG. 3 is a cross-sectional view taken along line 3-3 of the tool head of FIG. 1.
Figure 4:
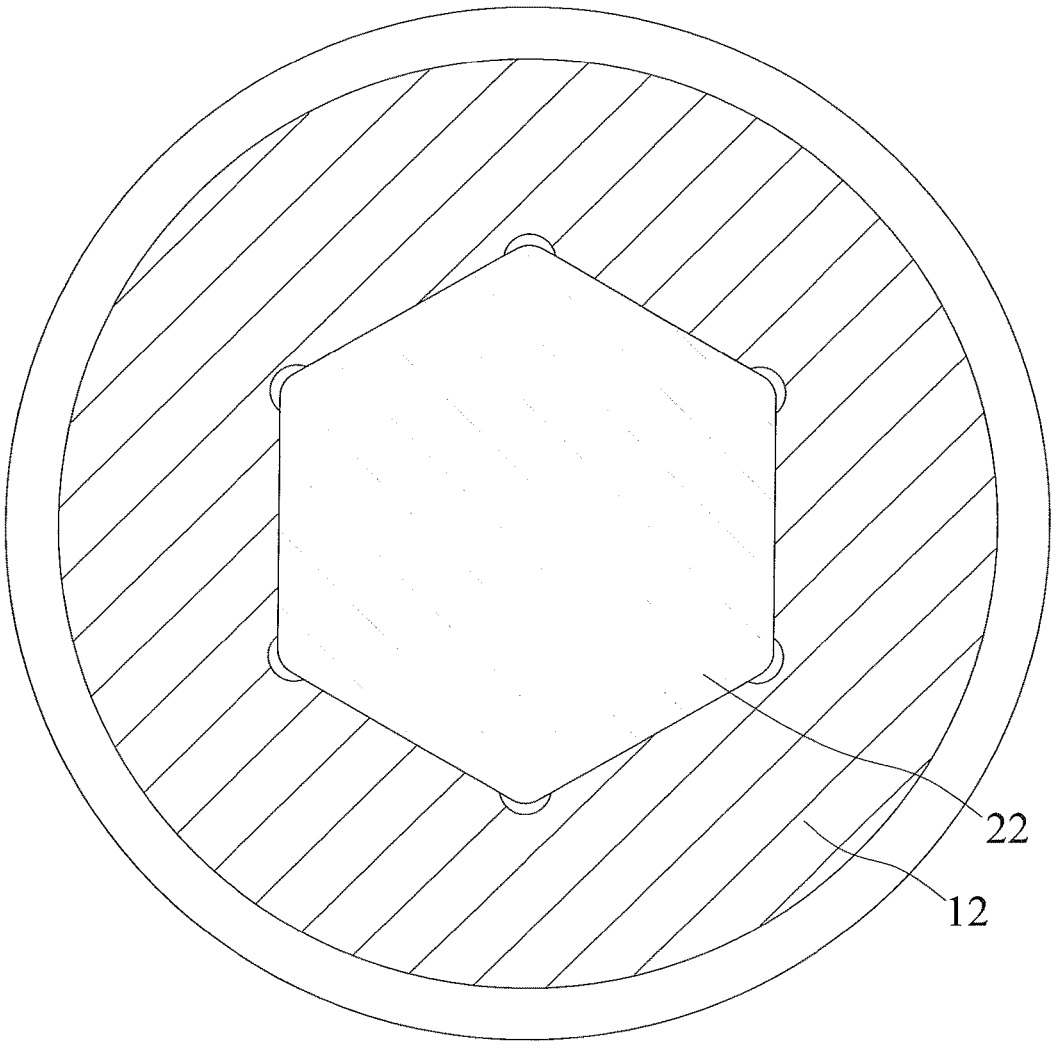
FIG. 4 is a cross-sectional view taken along line 4-4 of the tool head of FIG. 3.
Figure 5:
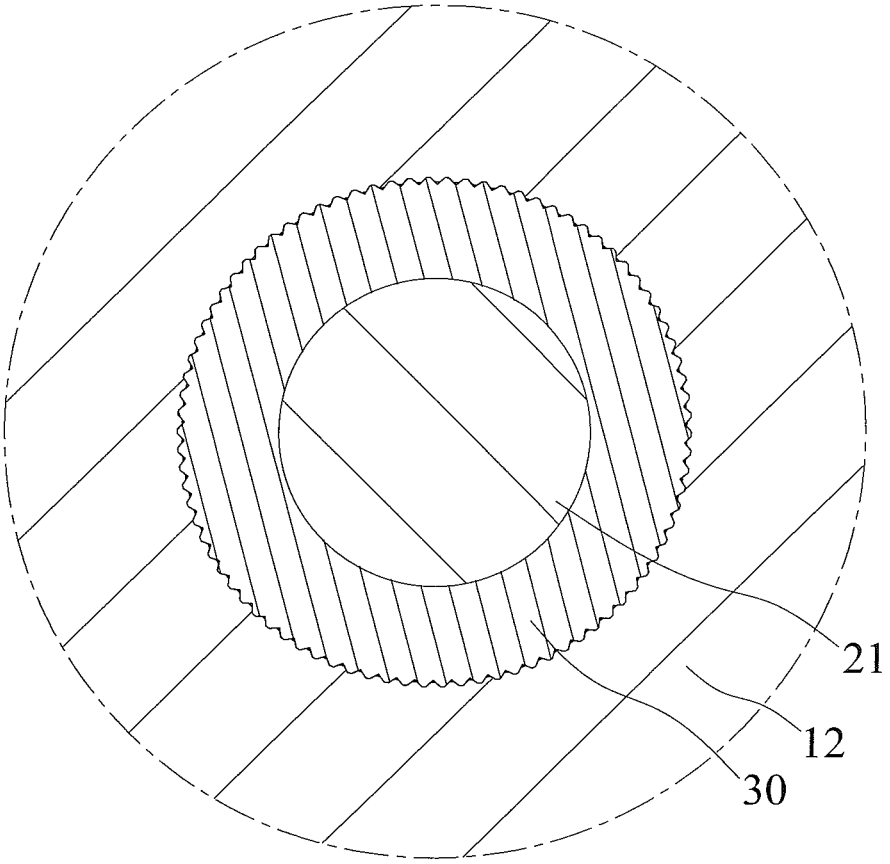
FIG. 5 is a cross-sectional view taken along line 5-5 of the tool head of FIG. 3.

FIGS. 1 through 5 show a tool head in accordance with a first embodiment of the present invention. The tool head is usable as an adaptor such that a tool is connectable to an end of the tool head and an object to be driven is connectable to another end of the tool head, respectively. The tool can be a power tool which can rotate the tool head in a rapid motion. The power tool includes a pneumatic tool or an electric tool.

The tool head includes a connecting component 10, a driving component 20, and a spacer 30 formed separately. The connecting component 10, the driving component 20, and the spacer 30 are assembled together.

The connecting component 10 has two opposite distal ends. The connecting component 10 extends in a lengthwise direction from a first distal end to a second distal end thereof. The connecting component 10 includes the first distal end thereof forming a connecting end 11 and the second distal end thereof forming a receiving end 12, respectively. The connecting end 11 forms a first receptacle 111. The tool is engagable with the first receptacle 111 to connect to the first connecting component 10. The first receptacle 111 extends in the lengthwise direction of the connecting component 10 from a first distal end to, a second distal end thereof. The first receptacle 111 is recessed from the first distal end of the connecting component 10. Therefore, the first receptacle 111 delimits an open end at the first distal end of the connecting component 10. The receiving end 12 forms a second receptacle 121. The driving component 20 is engagable with the second receptacle 121. The second receptacle 121 extends in the lengthwise direction of the connecting component 10 from a first distal end to a second distal end thereof. The second receptacle 121 is recessed from the second distal end of the connecting component 10. Therefore, the second receptacle 121 delimits an open end at the second distal end of the connecting component 10. The second receptacle 121 forms a first compartment 1211 and a second compartment 1212 open to the first compartment 1211. The first compartment 1211 is disposed adjacent to the second compartment 1212. The first compartment 1211 has two opposite distal ends. The first compartment 1211 extends in the lengthwise direction of the connecting component 10 from a first distal end to a second distal end thereof. The first distal end of the first compartment 1211 is at the first distal end of the second receptacle 121. The second compartment 1212 has two opposite distal ends. The second compartment 1212 extends in the lengthwise direction of the connecting component 10 from a first distal end to a second distal end thereof. The first distal end of the second compartment 1212 is open to the second distal end of the first compartment 1211. The second distal end of the second compartment 1212 is at the second distal end of the receptacle 121. The second receptacle 121 is of a countersunk shape. The first compartment 1211 has a diametrical size not greater than the second compartment 1212. The second compartment 1212 includes a plurality of vertical sides disposed circumferentially and forming a polygonal periphery. Each of the plurality of vertical sides of the second compartment 1212 extends at a first length L1 in a lengthwise direction of the receiving end. Further, a channel extends between and interconnects the first receptacle 111 and the second receptacle 121. The channel has a smaller diametrical size than the first compartment 1211.

The driving component 20 has two opposite distal ends. The driving component 20 extends in a lengthwise direction from a first distal end to a second distal end thereof. The driving component 20 includes the first distal end thereof forming an engaging end and the second distal end thereof forming a driving end 23, respectively. The engaging end is engagable with the receiving end 12. The engaging end is adapted to be inserted in the receiving end 12. The engaging end extends in the lengthwise direction of the driving component 10 from a first distal end to a second distal end thereof. The engaging end has a first engaging section 21 and a second engaging section 22 adjacent to the first engaging section 21. The first engaging section 21 has two opposite distal ends. The first engaging section 21 extends in the lengthwise direction of the driving component 20 from a first distal end to a second distal end thereof. The first distal end of the first engaging section 21 is at the first distal end of the driving component 20. The second engaging section 22 has two opposite distal ends. The second engaging section 22 extends in the lengthwise direction of the driving component 20 from a first distal end to a second distal end thereof. The first distal end of the second engaging section 22 is at the second distal end of the first engaging section 21. The first compartment 1211 is adapted to receive the first engaging section 21 and the second compartment 1212 is adapted to receive the second engaging section 22, respectively. The first engaging section 21 has a width smaller than the diametrical size of the first compartment 1211 such that a gap is formed between the first engaging section 21 and the first compartment 1211. The first engaging section 21 has an annular outer periphery. The second engaging section 22 and the second compartment 1212 have matching polygonal shapes. The first engaging section 21 has a first width W1, and the second engaging section 22 has a second width W2, respectively, in a widthwise direction of the driving component 20, which is perpendicular to the lengthwise direction of the driving component 20. The first width W1 is smaller than the second width W2. The first compartment 1211 has a width substantially greater than the first width W1. The second compartment 1212 has a width slightly greater than the second width W2 to such an extent that the second engaging section 22 can marginally insert in the second compartment 1212. The engaging end disposed outside the plurality of vertical sides of the second compartment measures a second length L2 in a lengthwise direction of the driving component. The second length L2 is smaller than the first length L1 The driving end 23 is engagable with the object to be driven by the tool head. The driving end 23 extends in the driving component 10 from a first distal end to a second distal end thereof. The second distal end of the driving end 23 is at the second distal end of the driving component 20. In the embodiment, the second distal end of the driving component is a Torx type screw drive, but not limiting.

The spacer 30 is not depressible. The spacer 30 is made of metal. The spacer 30 is in a shape of a ring. The spacer 30 is in a shape of an O-ring. The spacer 30 includes an inner periphery thereof forming a first tight-fit edge 31 and an outer periphery thereof forming a second tight-fit edge 32, respectively. The inner periphery of the spacer 30 is annular. The outer periphery of the spacer 30 is annular. The spacer 30 extends in a lengthwise direction from a first distal end to a second distal end thereof. The outer periphery of the spacer 30 has a third width W3 in a widthwise direction of the spacer 30, which is perpendicular to the lengthwise direction of the spacer 30. The third width W3 is smaller than the second width W2. The third width W3 is larger than the first width W1. The first tight-fit edge 31 is a smooth edge. The second tight-fit edge 32 is a serrated edge including a plurality of ridges disposed circumferentially. Each of the plurality of ridges extends lengthwise in the lengthwise direction of the spacer 30 from a first distal end to a second distal end thereof. The spacer 30 includes the first tight-fit edge 31 thereof engagable with the outer periphery of the first engaging section 21 and the second tight-fit edge 32 thereof engagable with the periphery of the first compartment 1211, respectively. The spacer 30 is prevented from moving into the channel because the diametrical size of the channel is smaller than the width W3.

Since the second length L2 is smaller than the first length L1, the polygonal shape of the second engaging section 22 is adapted to be disposed inside the plurality of vertical sides of the second compartment 1212. Thus, a problem that the driving component 20, the connecting component 10, and the spacer 30 can break or crack during assembly therebetween is able to solved. The first engaging section 21 can be precisely inserted into the first compartment 1211 after the second compartment 1212 receives the second engaging section 22, and the driving component 20 and the connecting component 20 can be in an aligned engagement.

The tool head is configured to prevent the connecting component 10 from detaching from the driving component 20. Moreover, the tool head is configured to prevent the connecting component 10 from rotating relative to the driving component 20. Moreover, the tool head is able to be rotated rapidly by a tool without suffering a problem that the driving component 20 detaches from the connecting component 10. Therefore, the tool head includes the first engaging section 21 and the spacer 30 tightly fit within the first compartment 1211, with the first tight-fit edge 31 surrounding and abutting the outer periphery of the first engaging section 21 and the second tight-fit edge 32 surrounding and abutting the periphery of the first compartment 1211, respectively, and with the spacer 30 disposed within the connecting component 10. The phrase tightly fit means that the first engaging section 21 is unable to disengage from and rotate relative to the spacer 30 and that the spacer 30 is unable to disengage from and rotate in the first compartment 1211. After the first engaging section 21 is tightly fit within the first compartment 1211, the second engaging section 22 received within the second compartment 1212 is then retained within the second compartment 1212.

In addition, the tool head has a tight-fit region in which the first tight-fit edge 31 abuts the outer periphery of the first engaging section 21 and the second tight-fit edge 32 abuts the periphery of the first compartment 1211, respectively. The tight-fit region has a first length L1 in a lengthwise direction of the tool head. Furthermore, the tool head has a fit region adjacent to the tight-fit region and in which the outer periphery of the second engaging section 22 received within the second compartment 1212 is retained within the second compartment 1212. The fit region has a second length L2. The first length L1 is smaller than the second length L2. However, the first length L1 is enough that the driving component 20 is prevented from detaching from and rotating relative to the connecting component 10. Furthermore, the second compartment 1212 includes the first length thereof, which has a constant diametrical size, measured a third length L3. The third length L3 is greater than the first length.

Figure 6:
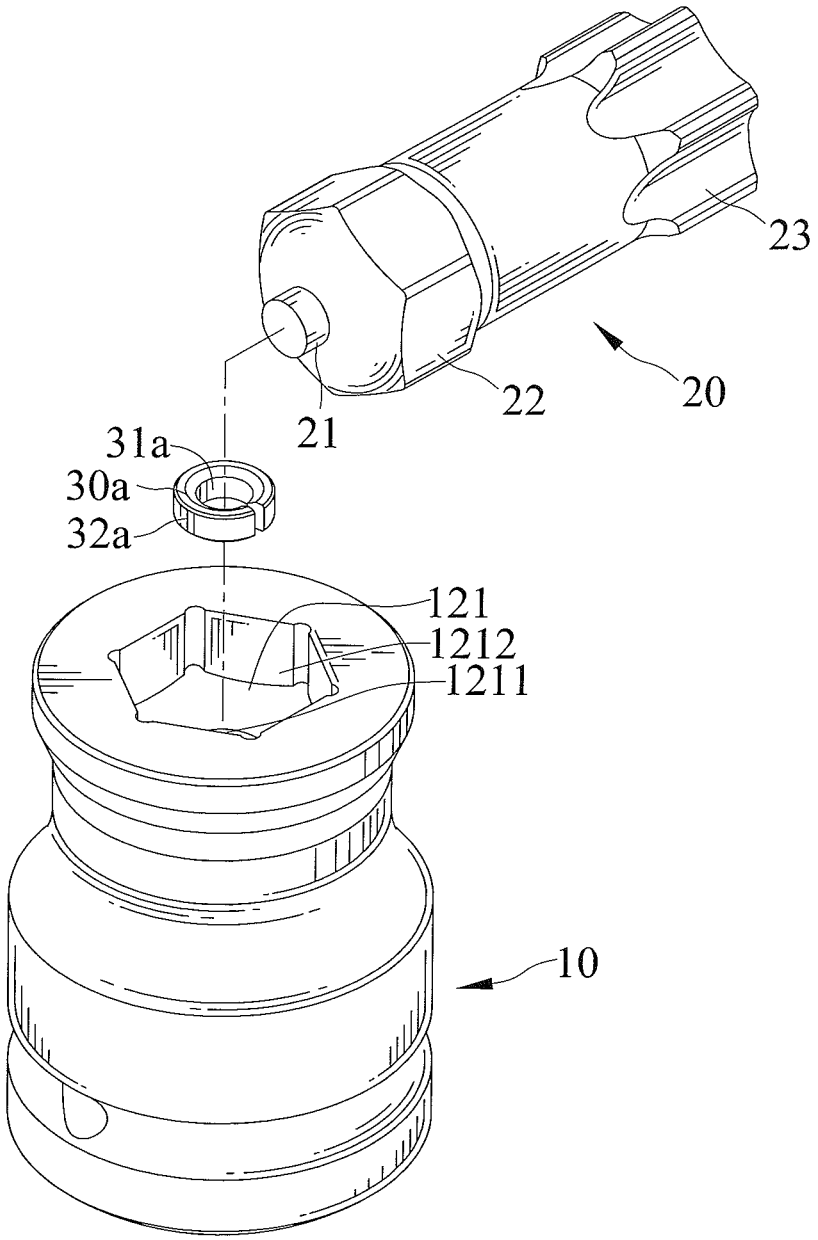
FIG. 6 is an exploded perspective view of a tool head in accordance with a second embodiment of the present invention.
Figure 7:
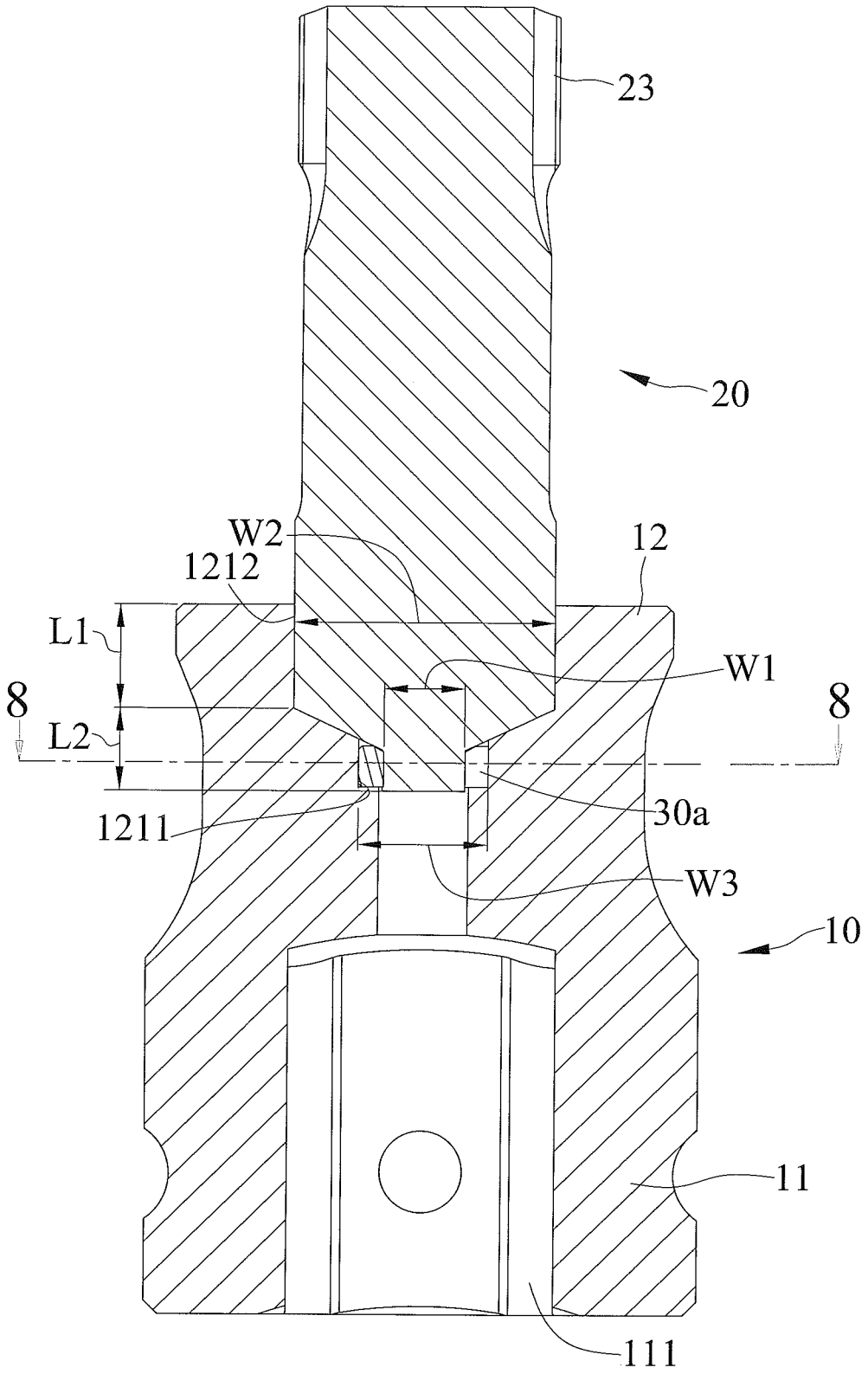
FIG. 7 is a cross-sectional view of the tool head of FIG. 6.
Figure 8:
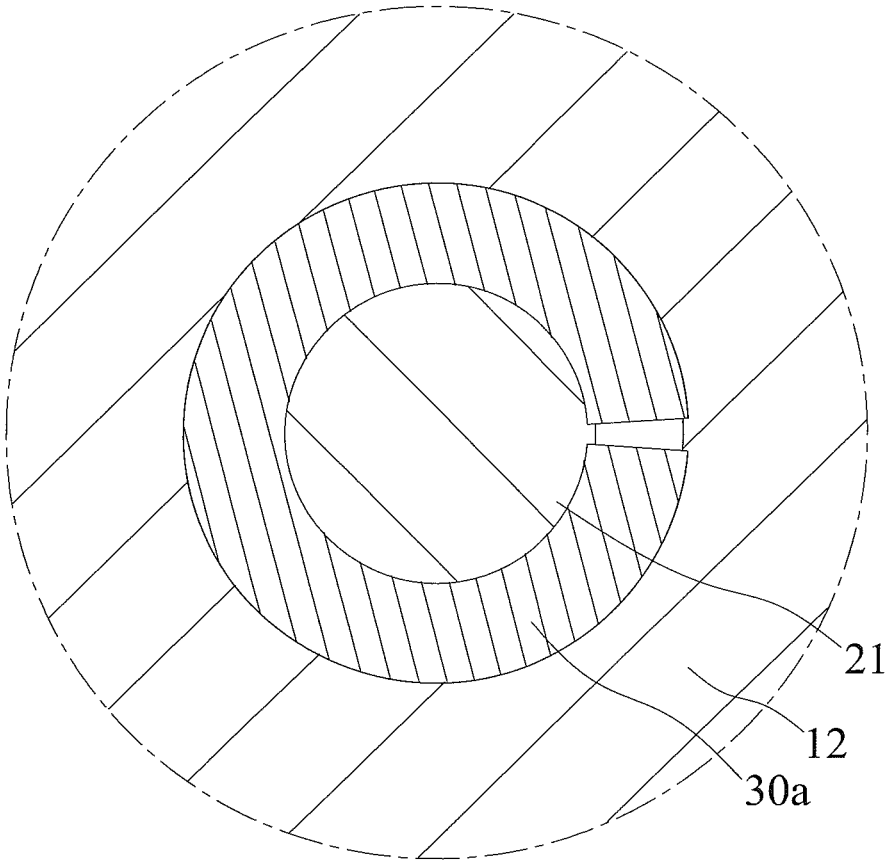
FIG. 8 is a cross-sectional view taken along line 8-8 of the tool head of FIG. 7.

FIGS. 6 through 8 show a tool head in accordance with a second embodiment of the present invention, and same numbers are used to correlate similar components of the first embodiment, but bearing a letter a. The second embodiment is the same as the first embodiment except that a spacer 30*a* replaces the spacer 30. The second embodiment has the same arrangements and geometries as the first embodiment. Therefore, similarity is not described repeatedly.

The spacer 30*a* is not depressible. The spacer 30*a* is also made of metal. However, the spacer 30*a* is in a shape of a C-ring. The spacer 30*a* includes an inner periphery thereof defining a first tight-fit edge 31*a* and an outer periphery thereof defining a second tight-fit edge 32*a*, respectively. The first and second tight-fit edges 31*a* and 32*a* are smooth edges. With the spacer 30*a* being C shaped, it is easier to assemble the tool head of the second embodiment than the first embodiment.

In view of the forgoing, the connecting component 10, the driving component 20 and the spacer 30 are tightly joined together. The tool head is configured to prevent the connecting component 10 from detaching from the driving component 20. Moreover, the tool head is configured to prevent the connecting component 10 from rotating relative to the driving component 20. Moreover, the tool head is able to be rotated rapidly by a tool without suffering a problem that the driving component 20 detaches from the connecting component 10.

While the specific embodiments have been illustrated and described, numerous modifications come to mind without significantly departing from the spirit of invention, and the scope of invention is only limited by the scope of accompanying claims.

What is claimed is:

1. A tool head usable as an adaptor such that a tool is connectable to an end of the tool head and an object to be driven is connectable to another end of the tool head respectively comprising:

a connecting component including a first distal end thereof forming a connecting end connectable to the tool and a second distal end thereof forming a receiving end respectively, with the receiving end forming a receptacle, with the receptacle forming a first compartment and a second compartment, with the first compartment having a diametrical size not greater than the second compartment, with the second compartment having one of two opposite distal ends opening to the first compartment and another distal end opening to the second distal end of the connecting component, with the second compartment including a plurality of vertical sides disposed circumferentially and forming a polygonal periphery, and with each of the plurality of vertical sides of the second compartment extending at a first length in a lengthwise direction of the receiving end;

a driving component including a first distal end thereof forming an engaging end insertable in the receiving end and a second distal end thereof forming a driving end connectable to the object to be driven respectively, with the engaging end inserted in the receiving end having a first engaging section received in the first compartment and a second engaging section received in the second compartment respectively, with the first engaging section having a width smaller than the diametrical size of the first compartment such that a gap is formed between the first engaging section and the first compartment, with the second engaging section and the second compartment having matching polygonal shapes, with the engaging end disposed outside the plurality of vertical sides of the second compartment measuring a second length in a lengthwise direction of the driving component, and with the second length smaller than the first length; and a spacer made of metal, having an annular shape, disposed in the gap, and including an inner periphery thereof forming a first tight-fit edge and an outer periphery thereof forming a second tight-fit edge respectively, with the first tight-fit edge surrounding and abutting the first engaging section, and with the second tight-fit edge surrounding and abutting with a periphery of the first compartment;

wherein the tool head is configured to prevent the connecting component from detaching from and rotating relative to the driving component, with the tool head having a tight-fit region in which the spacer tightly fits between the first engaging section and the first compartment and a fit region in which the second engaging section is received and retained within the second compartment.

2. The tool head as claimed in claim 1 wherein the inner periphery of the spacer is annular, and wherein the outer periphery of the spacer is annular.

3. The tool head as claimed in claim 2, wherein the first and second tight-fit edges are smooth edges.

4. The tool head as claimed in claim 2, wherein the first tight-fit edge is a smooth edge, and wherein the second tight-fit edge is a serrated edge.

5. The tool head as claimed in claim 4, wherein the second tight-fit edge includes a plurality of ridges disposed circumferentially.

6. The tool head as claimed in claim 5, wherein the second tight-fit edge includes a plurality of ridges disposed circumferentially, and wherein each of the plurality of ridges extends lengthwise in a lengthwise direction of the spacer.

7. The tool head as claimed in claim 2, wherein the spacer is in a shape of an O-ring.

8. The tool head as claimed in claim 2, wherein the spacer is in a shape of a C-ring.

9. The tool head as claimed in claim 4, wherein the spacer is in a shape of an O-ring.

10. The tool head as claimed in claim 3, wherein the spacer is in a shape of a C-ring.

11. The tool head as claimed in claim 1, wherein the connecting end forms a first receptacle, and wherein the tool is engagable with the first receptacle to connect to the first connecting component.

12. The tool head as claimed in claim 1, wherein the second compartment has a constant diametrical size between the plurality of vertical sides, wherein the second compartment extends divergently from ends of the plurality of vertical sides to the first compartment.

13. The tool head as claimed in claim 1, wherein the connecting component, the driving component, and the spacer are formed separately.

* * * * *